US005308177A

United States Patent [19]

Kawamura

[11] Patent Number: 5,308,177

[45] Date of Patent: May 3, 1994

[54] PRINTER WITH RIBBON HOLDER

[75] Inventor: Hiroki Kawamura, Aichi, Japan

[73] Assignee: Brother Kogyo Kabushiki Kaisha, Nagoya, Japan

[21] Appl. No.: 53,421

[22] Filed: Apr. 28, 1993

[30] Foreign Application Priority Data

Jun. 29, 1992 [JP] Japan ..... 4-196433

[51] Int. Cl.[5] ..... B41J 29/36

[52] U.S. Cl. ..... 400/697; 400/144.2; 400/214

[58] Field of Search ..... 400/695, 696, 697, 697.1, 400/153, 154, 154.1, 144.2, 208, 214

[56] References Cited

U.S. PATENT DOCUMENTS 4,728,208 3/1988 Iwase et al. ..... 400/697.1
5,171,094 12/1992 Kawamura ..... 400/697

FOREIGN PATENT DOCUMENTS 4-235082 8/1992 Japan .

*Primary Examiner*—Edgar S. Burr
*Assistant Examiner*—Ren Yan
*Attorney, Agent, or Firm*—Oliff & Berridge

[57] ABSTRACT

A printer comprises a type wheel, a print hammer and a guide member each disposed in parallel with a platen. The type wheel and print hammer are both disposed on a carriage body which is laterally reciprocated along a guide shaft. A holder member, on which a print ribbon and a correction ribbon are mounted, is disposed on the carriage body in such a manner as to be switchably turned between an erasing position, where the rear end thereof is lifted up by a predetermined height, and a print position where it is not lifted up. Correction ribbon taking-up mechanisms disposed in the holder member and the carriage body feed the correction ribbon stepwise to switch the position of the holder member. Furthermore, a swing limiter mechanism is provided for restraining the holder member from being lifted up beyond the erasing position.

13 Claims, 18 Drawing Sheets

PRINTER WITH RIBBON HOLDER

BACKGROUND OF THE INVENTION

Field of the Invention

This invention relates to a type wheel printer and, more particularly, to a printer where a holder member adapted to be lifted from a print position up to an erasing position is restrained from being swung upward beyond the erasing position in a character erasing operation.

Description of the Related Art

Heretofore, known electronic type wheel typewriters have a type wheel, a print ribbon, a correction ribbon, and drive mechanisms mounted on a carriage, so that the printing and erasure of characters can be effected.

In this type of electronic typewriter, a designated motor is provided for actuating each of the mechanisms. The motor includes a position changeover mechanism for switching a holder member, on which the print ribbon and the correction ribbon are mounted, between the print position, in which the print ribbon is placed opposite to the print hammer, and the erasing position, in which the correction ribbon is located opposite to the print hammer. The motor also includes a print hammer drive mechanism and a print ribbon take-up mechanism.

An electronic typewriter is disclosed in Japanese Unexamined Patent Publication No. 4-235082 published Aug. 24, 1992, which is not prior art to this application, wherein the position changeover mechanism for the holder member, the print hammer drive mechanism, the print ribbon take-up mechanism and a correction ribbon take-up mechanism are actuated by one motor disposed in a carriage body. Hence, a compact carriage can be manufactured at a reduced cost.

In this sort of electronic typewriter, a print cam for actuating the print hammer on a motor drive shaft of the motor and a lifter cam for lifting the holder member up to the erasing position so as to position the correction ribbon facing a character of the type wheel are integrally disposed. This lifter cam is provided with a reference cam for retaining the holder member at the print position, a periphery cam for retaining the holder member at the erasing position, and first and second tilt cams which are linked with the reference cam and the periphery cam, respectively. The holder member is provided with a follower pin slidable over the lifter cam. The follower pin is slid over the reference cam according to the forward rotation of the motor, thus actuating the print hammer via the print cam with the holder member retained in the print position. Meanwhile, the follower pin is slid over the periphery cam via the first and second tilt cams according to the forward or reverse rotation at a predetermined angle of the motor, thereby realizing an erasing operation with the holder member retained in the erasing position.

As described above, in this sort of electronic typewriter, the operation for lifting the holder member up to the erasing position is carried out simultaneously with the operation for printing a character by predetermined striking force by the print hammer via the print cam. Accordingly, the print cam must be rotated at a preset high speed by the motor, and at the same time, the lifter cam disposed integrally with the print cam is inevitably rotated at the high speed. As a result, the holder member is swung upward beyond the erasing position by its inertia when the holder member is rapidly lifted up according to rapid elevation of the follower pin sliding over the lifter cam. If the upward swing is large, the correction ribbon cannot face the type wheel, leading to the inability to erase a character.

Furthermore, since a print ribbon cassette is supported by the holder member with the aid of plural elastic members, the holder member is largely swung upward simultaneously when the print ribbon cassette is lifted upward in order to replace the print ribbon mounted on the holder member, with an attendant problem of extensional deformation of a tension spring for resiliently urging the holder member downward.

SUMMARY OF THE INVENTION

The present invention has been accomplished in an attempt to solve the above and other problems observed in the prior art. Hence, a primary object of the invention is to provide a printer where a holder member can be securely swung to the erasing position in operation for erasing a character.

A printer according to the invention comprises a type wheel, a print hammer and a guide member each disposed in parallel with a platen. The type wheel and print hammer are both disposed on a carriage body which is laterally reciprocated along a guide shaft. A holder member, on which a print ribbon and a correction ribbon are mounted, is disposed on the carriage body in such a manner as to be switchably turned between an erasing position, where the rear end thereof is lifted up by a predetermined height, and a print position where it is not lifted up. Correction ribbon taking-up mechanisms disposed in the holder member and the carriage body feed the correction ribbon stepwise in switching the position of the holder member. Furthermore, a swing limiter mechanism is provided for restraining the holder member from being lifted up beyond the erasing position when the holder member is lifted up to the erasing position.

The swing limiter mechanism provided in the printer is a locking arm member disposed in the holder member on the carriage body, which is constructed to abut against the guide member from below when the holder member is lifted up to the erasing position.

In the printer, the holder member, on which the print ribbon and the correction ribbon are mounted, is swung into the erasing operation for the erasing operation where the rear end of the holder member is lifted up by a predetermined height. At this moment, the swing limiter mechanism restrains the holder member from being lifted upward above the erasing position.

Consequently, a character can be certainly erased with the correction ribbon facing a character of the type wheel since the holder member can be restrained from being lifted up above the erasing position in the erasing operation.

BRIEF DESCRIPTION OF THE DRAWINGS

The invention is described with reference to the accompanying drawings in which.

DESCRIPTION OF PREFERRED EMBODIMENTS

Referring to the accompanying drawings, preferred embodiments of this invention will now be described in detail hereinbelow.

In the illustrated embodiment, the present invention is applied to an electronic typewriter, in which a single d.c. motor performs a printing operation followed by the take-up action of a print ribbon and an erasing operation followed by the take-up action of a correction ribbon.

Figure 1:
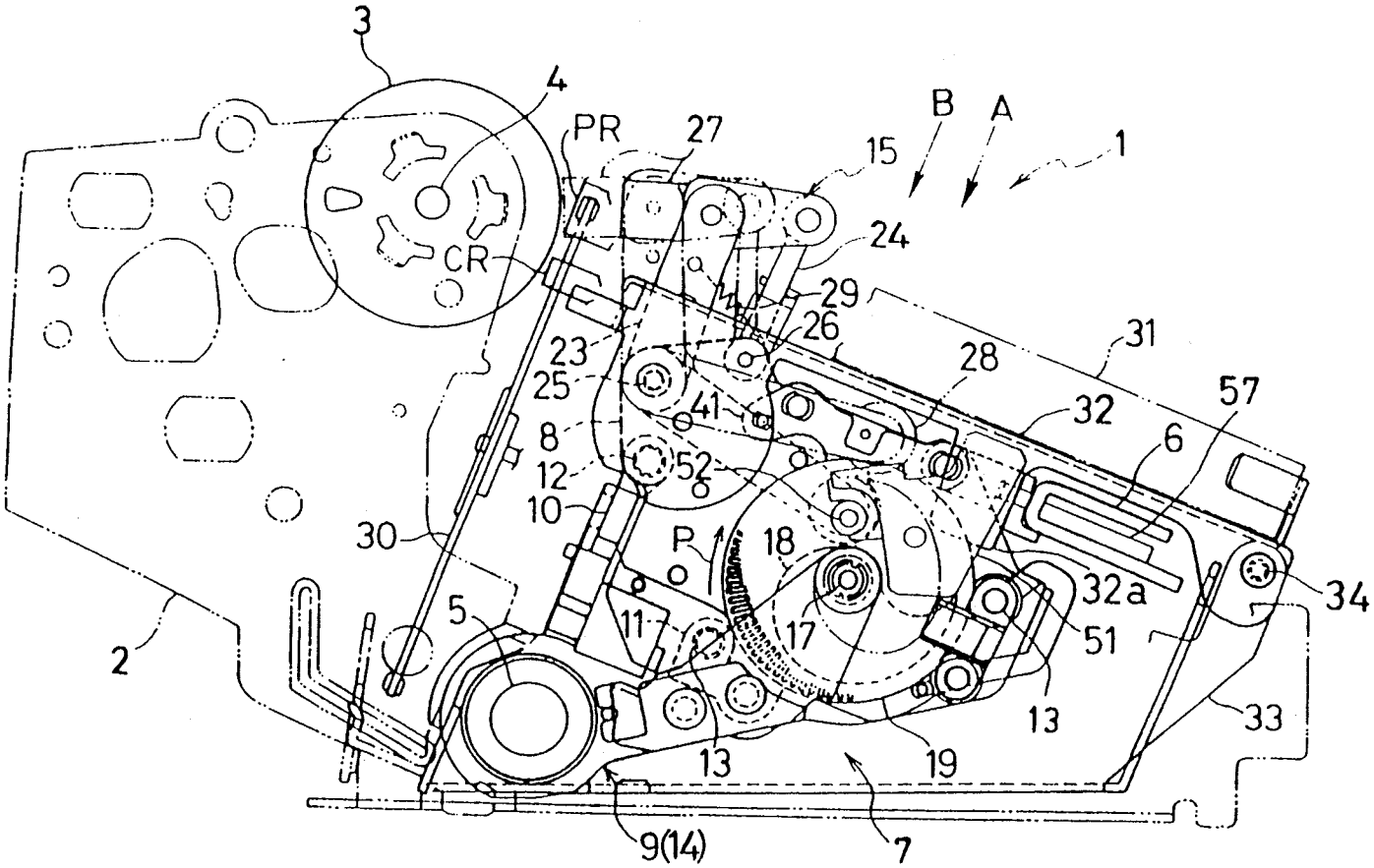
FIG. 1 is a side view showing an internal mechanism of an electronic typewriter according to the present invention.
Figure 2:
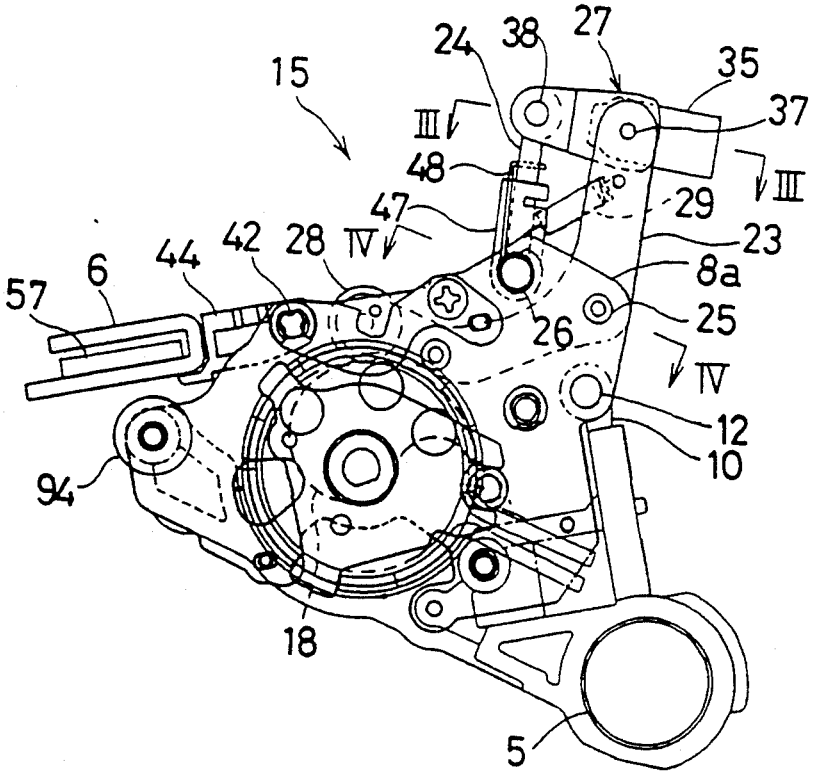
FIG. 2 is a side view showing a carriage of the electronic typewriter shown in FIG. 1.
Figure 10:
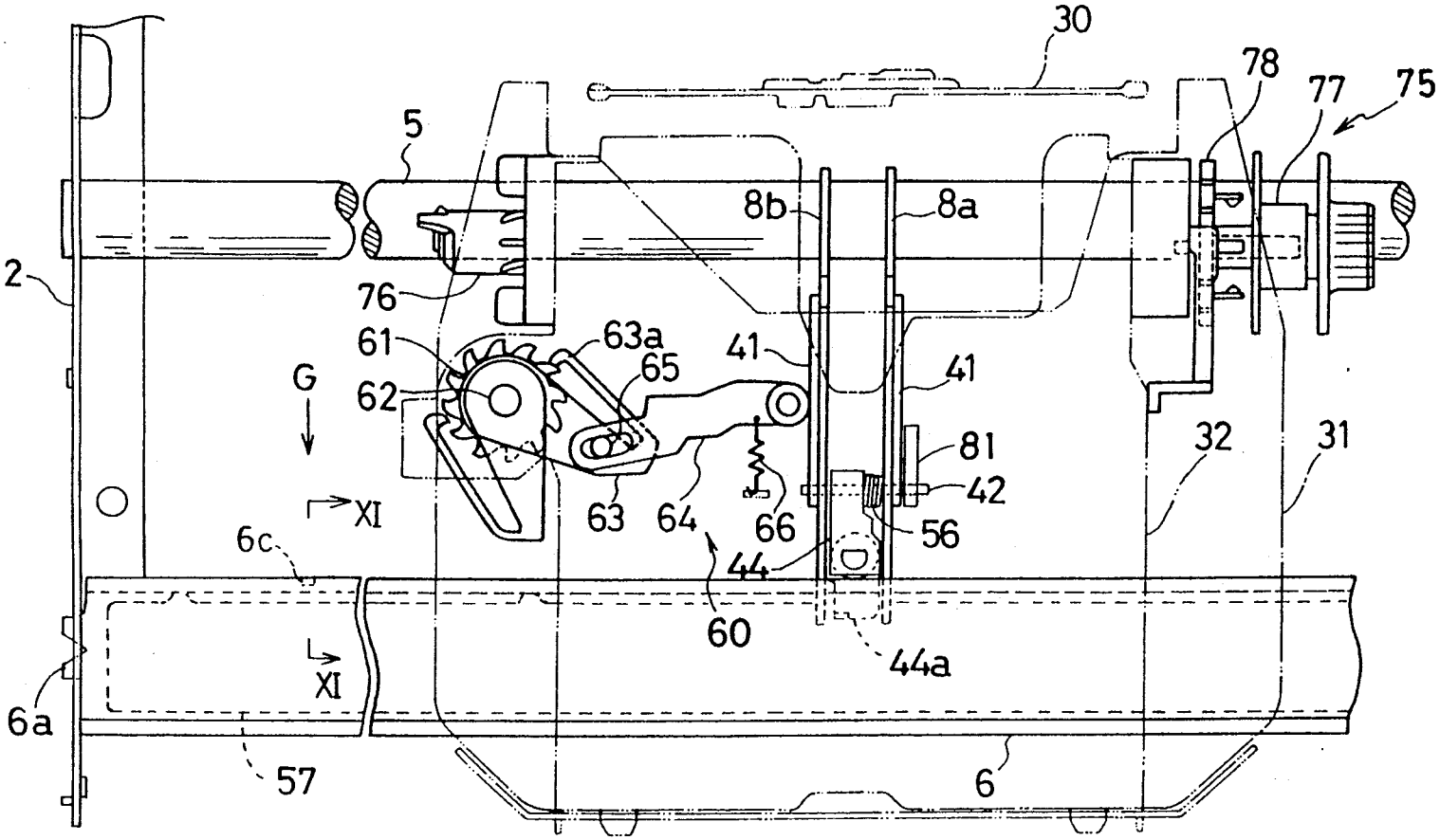
FIG. 10 is an illustration viewed from arrow B in FIG. 1.

As shown in FIGS. 1, 2 and 10, a typewriter 1 has a casing including side wall panels (machine frames) 2 positioned at respective right and left ends thereof. A platen 3 is interposed between the side wall panels 2 and is rotatably supported by the panels 2 in the vicinity of opposite ends of a platen shaft 4. As known, the platen 3 can be axially rotated by a non-illustrated line feed motor and a non-illustrated platen drive mechanism via a non-illustrated follower gear fixed to the left end of the platen shaft 4.

Between the pair of side wall panels 2 are further interposed a guide shaft 5 and a guide member 6 of substantial U shape as viewed in side elevation. The guide shaft 5 and the guide member 6 extend parallel to the platen 3.

In reference to FIGS. 5, 6, 7 and 10, a carriage 7 will be described hereinbelow, wherein the carriage is laterally and movably supported on the guide shaft 5 and the guide member 6. A pair of main frames 8*a* and 8*b* of substantially rectangular shape are located between and at right angles to the guide shaft 5 and the guide member 6. The main frames 8*a* and 8*b* are laterally spaced apart from each other along the guide shaft 5 and the guide member 6. A support member 9 is laterally, movably and rotatably supported on the guide shaft 5 and has first and second support arms 10 and 11 positioned, as a spacer, between the main frames 8*a* and 8*b*. In detail, the main frames 8*a* and 8*b* are fixed by pins 12 and 13, from the outside, to the upper ends of the first and second support arms 10 and 11. The main frames 8*a* and 8*b* and the supporting member 9, in combination, constitute a carriage body 14.

Figure 6:
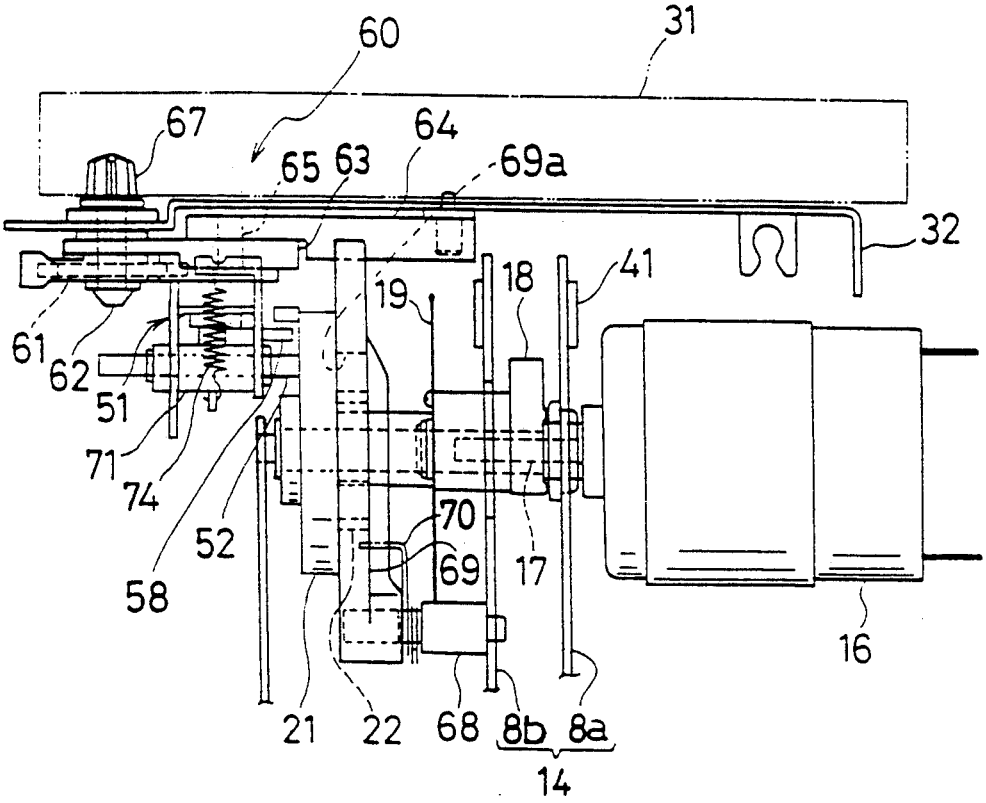
FIG. 6 is a partial front view showing the internal mechanism of the electronic typewriter according to the present invention.

A print mechanism 15 will now be described. A d.c. motor 16 is stationarily supported by the right main frame 8*a* and has a drive shaft 17 extending to the left through the main frames 8*a* and 8*b* as seen in FIG. 6. Mounted on this drive shaft 17, in order from the motor 16, are a print cam 18, with a spiral shape in side elevation, disposed between the main frames 8*a* and 8*b*; an encoder disc 19, with a plurality of slits defined in an outer periphery thereof; and a lifter cam 21 for elevating a holder member 32 and a ribbon supply cam 22 to the erasing position, the ribbon supply cam feeding a print ribbon PR stepwise. The ribbon supply cam 22 and the lifter cam 21 are integrally joined with each other. In FIG. 1, a dotted line denotes the print start position of the print cam 18, while a two-dot chain line represents the original preset position of the same.

Figure 3:
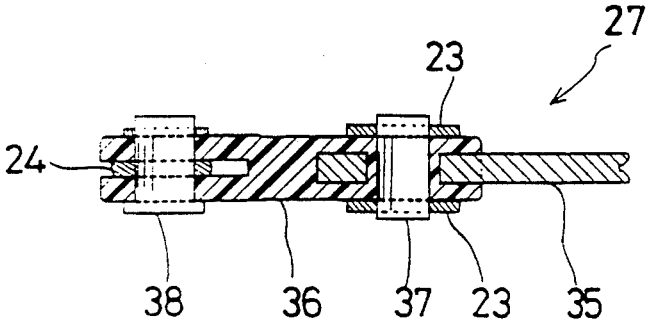
FIG. 3 is a partial sectional view taken along a line III—III of FIG. 2.
Figure 4:
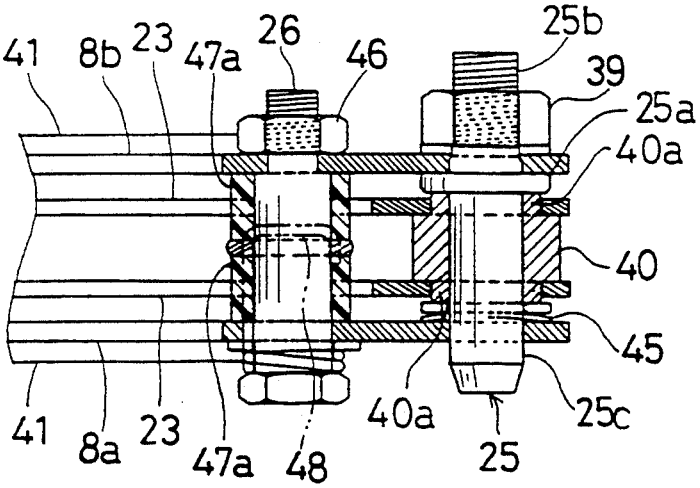
FIG. 4 is a partial sectional view taken along a line IV—IV of FIG. 2.

Shown in FIGS. 2–4, a pair of turn levers 23 of substantial L shape in side elevation and a link 24 are supported on upper rear end portions of the main frames 8*a* and 8*b* by a pin 25 and a machine screw 26, respectively, with the center of the levers 23 and a lower end of the link 24 angularly and movably supported. A print hammer 27, as shown in FIGS. 1 through 3, is positioned at a right angle, and in opposition, to the platen 3. The print hammer 27 includes a metal hammer body 35 and a resilient holder member 36 which supports the approximate front half of the hammer body 35.

The front end of this print hammer 27, specifically the front end of the holder member 36, is angularly supported at the upper end of the link 24 by means of a pin 38. The print hammer 27, longitudinally at the center thereof is also angularly and movably supported by means of a pin 37 at the upper end of the turn levers 23. In short, the substantial upper ends of the link 24 and turn lever 23, the pins 25, 37 and 38, and the machine screw 26 constitute, in combination, a parallel linkage. The print hammer 27 is fixed to the main frames 8*a* and 8*b* via this parallel linkage, whereupon the print hammer 27 is reciprocally movable substantially linearly towards the platen.

Since the metal pin 37 and the hammer body 35 are kept out of direct contact via the holder member 36, an impacting noise occurring during the printing and erasing operations (described later) can be inevitably eliminated.

As seen in FIG. 2, a cam follower 28 is rotatably provided at the front end of the turn lever 23, and a tension spring 29 is extended between an upper end portion of the turn lever 23 and a lower end portion of the link 24 so that the cam follower 28 can be constantly held in contact with the cam surface of the print cam 18.

With reference to FIGS. 2 and 4, pivotal supporting arrangement will now be described, in which the turn lever 23 is pivotally supported by the main frames 8*a* and 8*b* with the pin 25.

The flange headed pin 25 is composed of a flange 25*a*, a screw head 25*b* and a pin 25*c*, wherein the screw head 25*b* and the pin 25*c* are jointed integrally, with the flange 25*a* sandwiched therebetween. The screw head 25*b* is inserted into a pin hole of the main frame 8*b*, whereas the pin 25*c* is inserted into a pin hole of the main frame 8*a*. The main frame 8*b* is fixed between the flange 25*a* and a nut 39 secured to the screw head 25*b*.

This arrangement ensures that the main frame 8*b* is positioned at a right angle to the axis of the flange headed pin 25, whereupon the pin holes of the main frames 8*a* and 8*b* are accurately matched with each other via the flange headed pin 25. Hence, the main frames 8*a* and 8*b* can be positioned easily and precisely, facing each other.

The pair of turn levers 23 are pivotally supported on the flange headed pin 25 via a spacer 40 which has outwardly raised receivers 40*a*. The receivers 40*a* of the spacer 40 are attached to the pair of turn levers 23, respectively, by caulking. A countersunk-head washer 45 is provided around the flange headed pin 25 between the main frame 8*a* and the right turn lever 23, opposite to the main frame 8*a*. The resilience of the countersunk-head washer 45 absorbs longitudinal clearances between the turn levers 23 and the main frames 8*a* and 8*b*.

Eventually, the reaction force, resulting from the striking action of the print hammer 27 during the printing operation, evenly acts on both main frames 8*a* and 8*b* via the flange headed pin 25. This reaction force is finally received by the guide member 6 via an abutting member 44 (described later), and hence the striking force (impact) of the print hammer 27 can be definitely absorbed.

Referring to FIGS. 2 and 4, another pivotal supporting arrangement will be explained hereunder, wherein the lower end of the link 24 is pivotally supported by the main frames 8*a* and 8*b* via the ridged machine screw 26 and a protecting member 47. The ridged machine screw 26 passing through the main frame 8*a* is fixed to the main frame 8*b* by means of a nut 46, and hence the link 24 is, at the lower end thereof, pivotally supported by the screw 26. The protecting member 47, which is made of synthetic resin and is of U shape, is provided around the link 24, and extends from the middle height of the link 24 to the bottom end thereof. A notched support 47*a*, formed at the lower end of the protecting member 47, is fitted on the exterior of the screw 26 at both right and left sides of lower ends of the link 24. A spring member 48 at one end thereof coiled around the end of the threaded machine screw 26, opposite to its nut end, is extended upwardly, and is diagonally engaged with an upper side portion of the link 24 opposite to the coiled end of the screw 26.

Accordingly, the link 24 and the print hammer 27 coupled therewith are constantly urged to the right by the resiliency of the spring member 48 as viewed in FIG. 2. With respect to the parallel linkage, clearances can be always provided on predetermined sides of the joints between the print hammer 27 and the turn lever 23, between the print hammer 27 and the link 24, and between the link 24 and the main frames 8*a* and 8*b*, as a result of which striking noises of the print hammer 27, especially high frequency noises, can be reduced during the printing and erasing operations.

Figure 5:
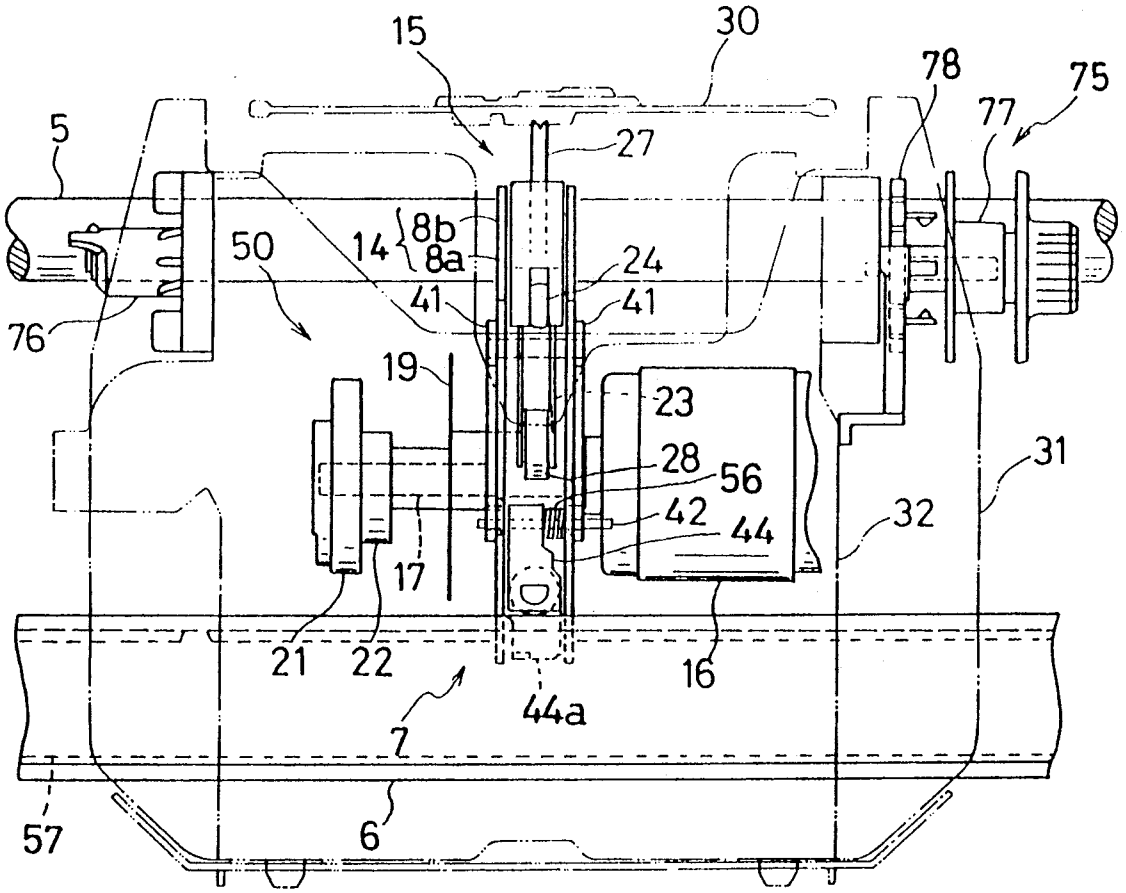
FIG. 5 is an illustration viewed from arrow A in FIG. 1.

Reference numeral 30 in FIGS. 1 and 5 designates a daisy wheel which is rotatably actuated by a wheel drive motor 49 (see FIG. 13) and a non-illustrated wheel drive mechanism. A ribbon cassette 31 accommodates a print ribbon PR therein. A holder member 32 for detachably supporting the ribbon cassette 31 by the use of plural elastic members, not shown, is vertically swung, via a support shaft 34, on a holder bracket 33 pivoted movably on the guide shaft 5 in the lateral direction together with the carriage body 14. The carriage 7 is reciprocated laterally along the platen 3 by means of a non-illustrated carriage drive motor and a non-illustrated drive mechanism via a drive wire.

Figure 7:
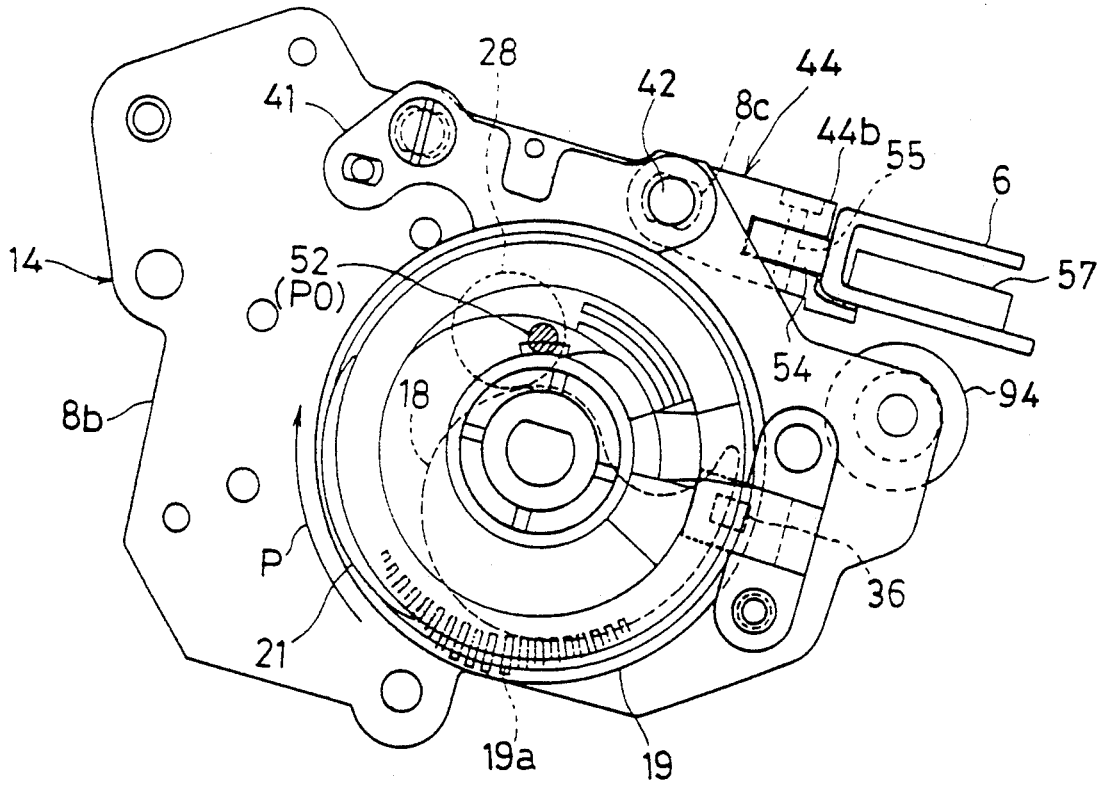
FIG. 7 is a side view showing a main frame and a guide member.

As shown in FIG. 7, the exterior curved cam surface of the print cam 18, on which the cam follower 28 slidably rides, has a half contact area with a large radial magnifying factor and a half contact area with a nominal radial magnifying factor. The print cam 18 also has a predetermined length of further curved extension in addition to the contact areas set forth so that the print hammer 27 is kept pressed against the platen 3 after the striking action of the print hammer 27.

When the motor 16 is energized to make a fast angular rotation from the print start position by a predetermined angle toward the printing direction P in FIG. 1, the cam follower 28 travels upwardly along the cam surface of the print cam 18, whereupon the turn lever 23 is rotated counterclockwise, and the print hammer 27 strikes the platen 3 and is kept pressed against the same through a letter of the daisy wheel 30 along with the print ribbon PR.

A pair of adjusting plates 41 are respectively fixed to upper and outer end portions of the main frames 8*a* and 8*b* and extend in the front rear direction of the main frames. A support shaft 42, seen in FIGS. 5 and 7, passing through oblong holes 8*c* formed in respective main frames 8*a* and 8*b*, is fixed to front ends of the adjusting plates 41.

Figure 11:
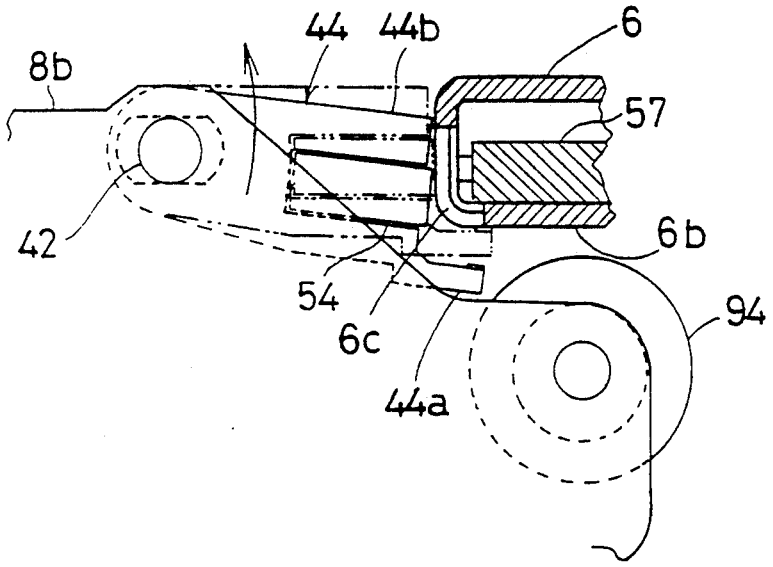
FIG. 11 is a cross-sectional view taken along the line XI—XI of FIG. 10.

As can be seen from FIGS. 7 and 11, an abutment member 44 is pivotally supported at the rear end of the support shaft 42 and has an abutment portion 44*b*. A bearing 54, which makes slidable contact with the rear end surface of the guide member 6, is angularly and movably supported at the front end of the abutment portion 44*b* by means of a pivotal shaft 55. In reference to FIGS. 5 and 10, this abutment member 44 is angularly urged to be turned counterclockwise in FIG. 7 by means of a coiled spring 56 coiled around the support shaft 42. Hence, a guide 44*a* protruding from the front end of the abutment portion 44*b* is constantly held in contact with the lower portion of the guide member 6. Namely, the bearing 54 is constantly brought into contact with the rear end surface of the guide member 6, which enables the carriage 7 to travel smoothly and reciprocally.

The reaction, resulting from the striking action and depression of the print hammer 27 at the printing operation, is absorbed by the guide member 6 via the print mechanism 15 and the abutment member 44. In order to increase the strength of the guide member 6, as shown in FIGS. 1, 5, 7 and 10, a reinforcing material 57 made of a plate is housed in the guide member 6 over the entire length thereof. This reinforcing material 57 is joined to the guide member 6 at a plurality of points by spot welding. As shown in FIG. 10, notched opposite ends 6*a* of the guide member 6 are fixed to the side wall panels 2, respectively, by hot caulking.

Referring to FIGS. 5 to 8, a cam mechanism 50 will now be described, wherein the cam mechanism lifts the holder member 32 from the print position to the erasing position in order to hold the correction ribbon CR in opposition to the print hammer 27 during the erasing operation.

The lifter cam 21 includes a reference cam 21*a* with an even radius; a first tilt cam surface 21*b* radially, outwardly, clockwise and successively extending from the reference cam 21*a*; a second tilt cam surface 21*c* connecting between the first tilt cam surface 21*b* and an outer cam surface 21*d*; an outer edge wall 21*e* which is defined on the right end of the outer cam surface 21*d* and extends radially outward; and a leftward raised rib 21*f* formed along the outer edge of the outer edge wall 21*e*.

At a part of the outer edge wall 21*e*, a shallow depth region 21*h* is formed, the depth of which increases progressively toward the center of the cam by about one third of the depth difference between the bottom of the outer edge wall 21*e* and a curvature 21*p* leftward raised from the first tilt cam surface 21*b*, namely, total axial displacements (i.e., about 5 mm) of a first follower pin 52. A tilt surface 21*i* starts from the shallow depth region 21*h* up to a left end surface 21*g* of the cam 21. This tilt surface 21*i* has a lateral gradient toward the center of the cam by about one third of the level difference between the edge thereof nearest the cam center and the outermost edge thereof. The angular advancing and angular retarding portions of the shallow depth region 21*h* are joined with the outer edge wall 21*e*, respectively, at the tilt surface.

Figure 8:
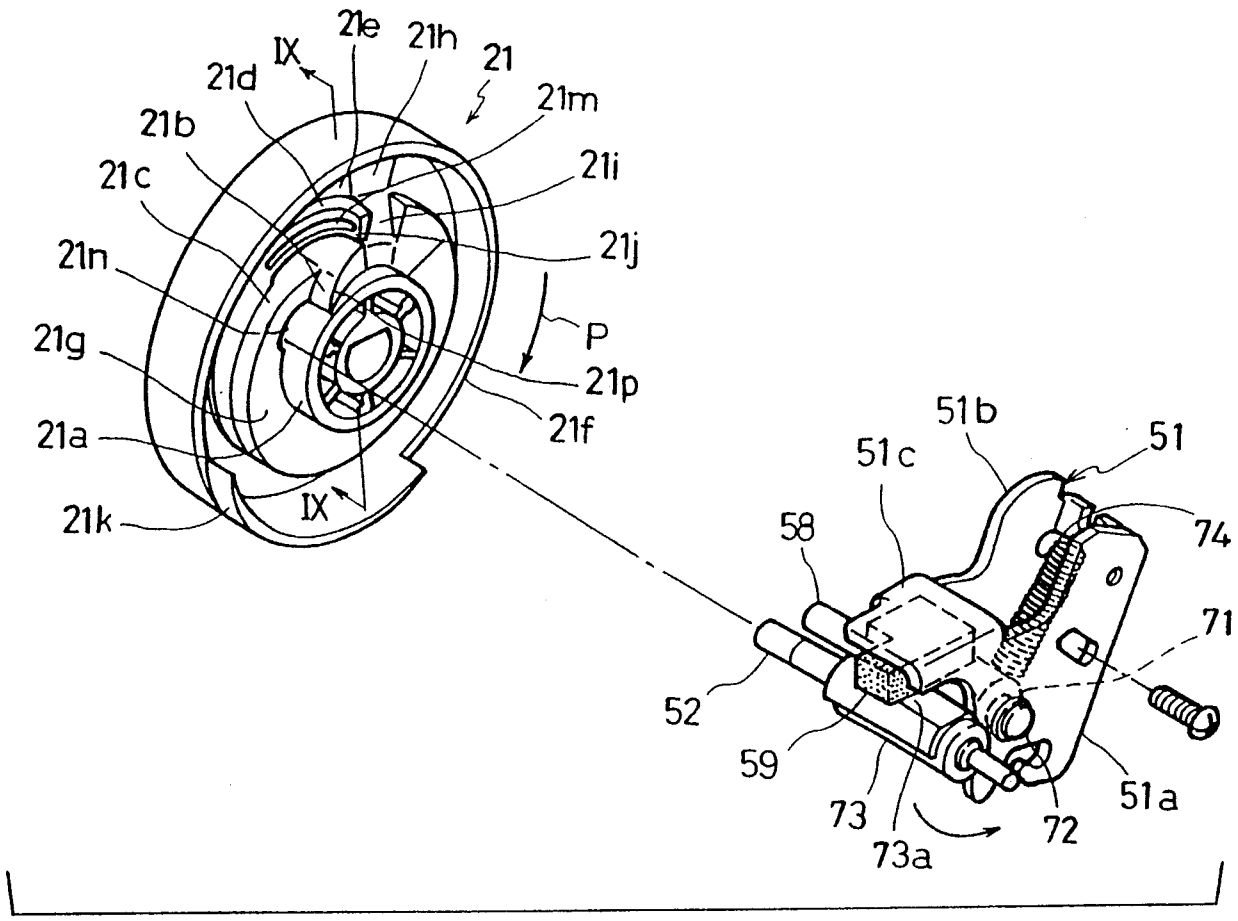
FIG. 8 is an exploded perspective view showing a lifter cam and a supporting member.
Figure 9:
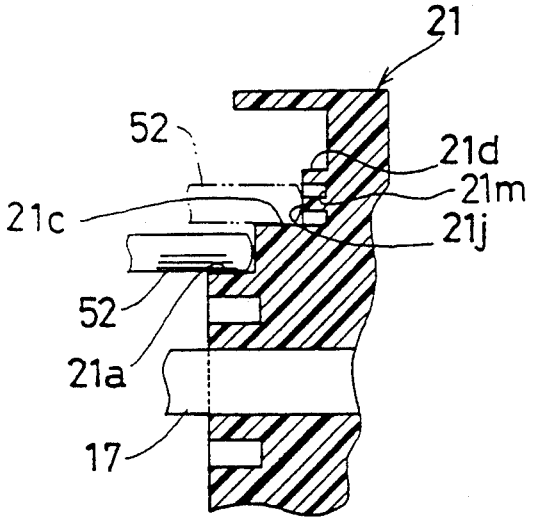
FIG. 9 is a partial sectional view taken along a line IX—IX of FIG. 8.

A double-threaded circular-arc groove 21*m* is formed on a guide surface 21*j* between the second tilt cam surface 21*c* and the outer cam surface 21*d* as shown in FIGS. 8 and 9. Likewise, the left end surface 21*g*, corresponding to the left end of the first tilt cam surface 21*b*, also has a double-threaded circular-arc groove 21*n*.

As seen in FIG. 8, a pin guide cam 21*k* protrudes leftwardly from the rib 21*f*, and extends by about one fourth of the entire circumference of the rib 21*f*, wherein the rib 21*f* starts from a point in the vicinity of the end of the second tilt cam surface 21*c*. The pin guide cam 21*k* is adapted to be engaged with a second follower pin 58, described later.

A support member 51 will be described with reference to FIGS. 6, 8 and 16, wherein the support member 51 supports a first follower pin 52 (corresponding to a cam follower pin) that is brought into contact with the lifter cam 21 from the left and a second follower pin 58.

As seen in the figures, this support member 51 comprises: an attachment wall 51*a* which is secured to a part of the side wall 32*a* on the left end of the holder member 32; a receiver wall 51*b* positioned leftward and closely parallel to the attachment wall 51*a*; and a support wall 51*c* in a joined fashion extending between the attachment wall 51*a* and the receiver wall 51*b*. A rotating member 71, which is sandwiched between the attachment wall 51*a* and the receiver wall 51*b* and which is made of synthetic resin, is rotatably supported by a pivot pin 72 which is laterally supported by both walls 51*a* and 51*b*.

This rotating member 71 is provided with a pin retainer member 73 holding first follower pin 52 and second follower pin 58. This pin retainer member 73 constantly and resiliently urges the first follower pin 52 rightward and retains it, with the help of the biasing force of a non-illustrated compression spring.

A tension spring 74 is extended between a lower end part of the rotating member 71 and the receiver wall 51*b*. Hence, the rotating member 71 is resiliently urged to turn counterclockwise so that the first follower pin 52 can constantly follow the lifter cam 21.

On an upper part of the pin retainer member 73 is disposed a receiver 73*a* for receiving the support wall 51*c* from its bottom. This receiver 73*a* has a rubber cushion member 59 attached to the upper end thereof, whereupon the pin retainer member 73 is resiliently brought into contact with the support wall 51*c* via this cushion member 59.

Figure 16:
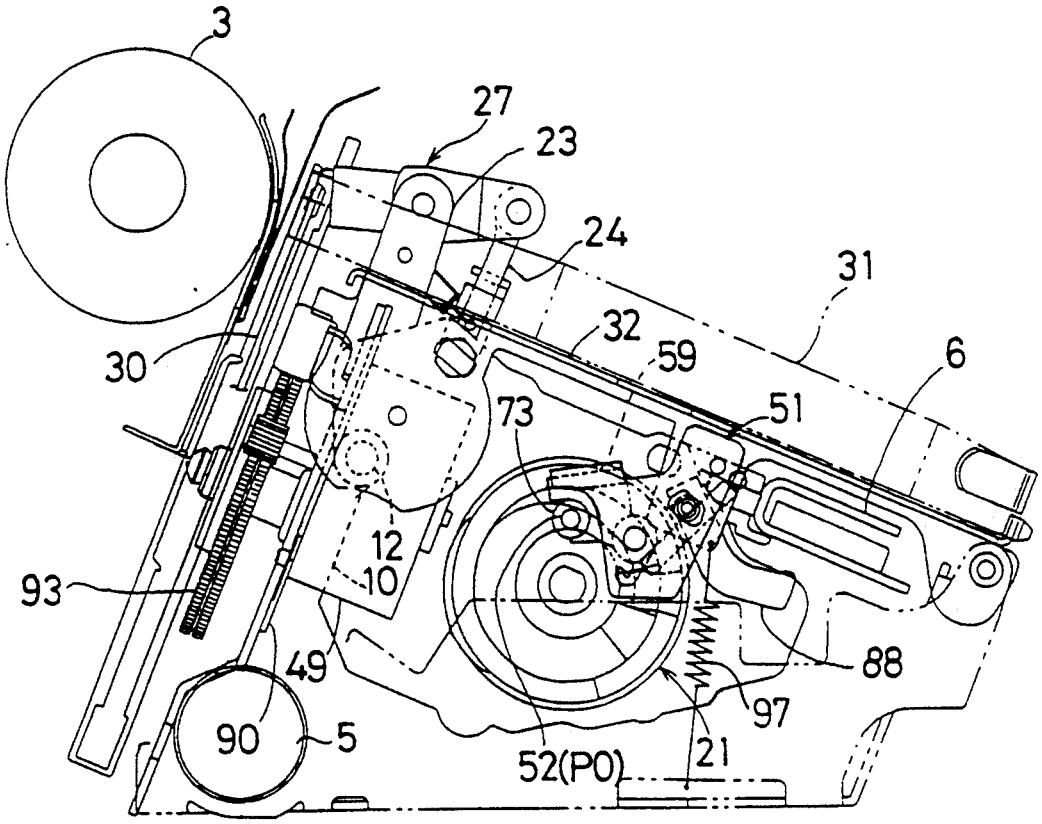
FIG. 16 is an illustration similar to FIG. 1 schematically showing the internal mechanism in the printing state.
Figure 17:
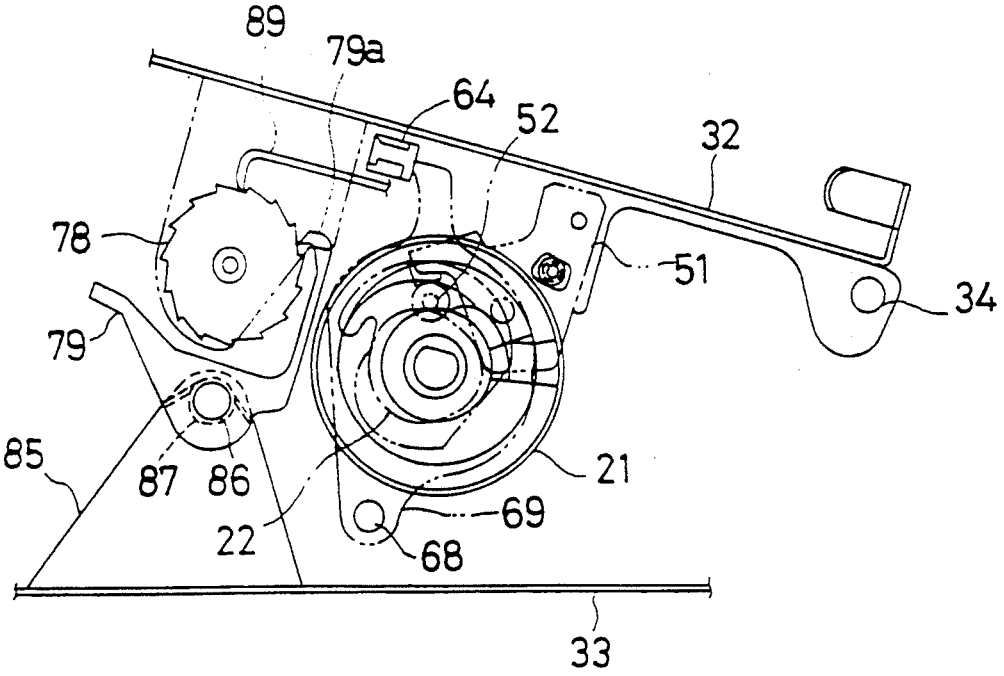
FIG. 17 is a side elevation view showing the principal parts of the internal mechanism at the print start position.

With this arrangement, the first follower pin 52 normally holds the holder member 32 in the print position (reference angular position) shown in FIGS. 1, 16 and 17 via the rotating member 71 and support member 51, with the tip end of the first follower pin 52 held against the reference cam 21 from above thereof by the biasing force of a tension spring 97 (see FIG. 16), extended between the holder member 32 and a holder bracket 33, and the weight of the holder member 32. The tip of the first follower pin 52 is also resiliently urged against the left end surface 21*g*.

The amount of angular displacement of the holder member 32 is dependent on the amount of longitudinal displacement of the first follower pin 52. FIG. 7 illustrates the positional relationship between the print cam 18, the lifter cam 21, the first follower pin 52 and the cam follower 28 at the start of the printing operation. Assume that the position of the first follower pin 52 at the print start is designated with P0 (see FIG. 15).

When the lifter cam 21 is rotated by means of the motor 16 by a given angle from a phase angle at the print start, shown in FIGS. 7 and 8, to the direction opposite to the printing direction P (hereinafter referred to as the non-printing direction), the first follower pin 52 is displaced upward along the first tilt cam surface 21*b*, whereupon the holder member 32 is angularly lifted in response to upward displacement of the first follower pin 52. Upon rotation of the lifter cam 21 in the printing direction P, the first follower pin 52 reaches the outer peripheral cam surface 21*d* via the second tilt cam surface 21*c*, whereupon the holder member 32 is angularly elevated further upward to the erasing position shown in FIGS. 18 and 19. At this time, the correction ribbon CR is situated opposite to the print hammer 27.

During the upward displacement of the first follower pin 52 along the first tilt cam surface 21*b*, the tip end of the first follower pin 52 is pressed against the left end surface 21*g*; namely, the follower pin 52 undergoes a great resilient biasing force. When the first follower pin 52, by such a great resilient biasing force, travels up to the second tilt cam surface 21*c*, the tip end of the follower pin 52 forcibly impinges against guide wall 21*j*, which, in turn, causes a clipping sound. As has been mentioned, the double groove 21*m* is formed over the guide wall 21*j*, and this groove hinders the transmission of vibrations, especially vibrations having a high frequency resulting from the impingement, over the entire cam 21, thereby reducing the noise.

In reference to FIGS. 6 and 10, a print ribbon take-up mechanism 60 will be described, wherein the mechanism winds up a print ribbon PR by a predetermined length in each print operation.

A ratchet 61 having a plurality of teeth is rotatably supported by a pin 62 on the under left end of the holder member 32. A third swing member 63, with a feed pawl 63*a*, is also rotatably supported by this pin 62. The third swing member 63 is linked with a second swing member 64 which is angularly and movably mounted on the holder member 32 by a coupling pin 65. The second swing member 64 is resiliently urged to turn counterclockwise in FIG. 10 by means of a tension spring 66. A take-up spool 67 is fixed to the pin 62.

The lower end part of a first swing member 69 is angularly and movably supported by a pivot pin 68 secured to the main frame 8*b* in positional alignment with the substantially spiral-shaped ribbon supply cam 22, whereas the upper end part of the first swing member 69 is held against the second swing member 64 near the proximal end thereof from the front of the swing member 64. The ribbon supply cam 22 is positioned in a substantially circular hole 69*a* defined in the first swing member 69. The first swing member 69 is normally urged in the upward direction of the paper in FIG. 6, suitably oriented for reading, by the resiliency of a spring 70 wound around the pivot pin 68 so that a part of the first swing member 69 can normally abut against a part of the ribbon supply cam 22.

When the ribbon supply cam 22 is rotated in the printing direction P by the motor 16, the first swing member 69 is displaced in the downward direction of the paper in FIG. 6, suitably oriented for reading, in accordance with the cam profile of the ribbon supply cam 22, whereupon the second swing member 64 is rotated clockwise in FIG. 10 and a third swing member 63 is rotated counterclockwise. Eventually, the feed pawl 63*a* of the third swing member 63 causes the ratchet 61 to rotate one tooth of the ratchet, so that the print ribbon PR is fed stepwise in a predetermined increment by the rotation of the take-up spool 67 immediately prior to printing.

A correction ribbon take-up mechanism 75 will be described with reference to FIGS. 5, 10, 13 and 17, wherein the mechanism winds up the correction ribbon CR on a take-up spool by a predetermined length during the erasing operation.

A correction ribbon CR supply spool 76 is rotatably mounted on the side wall 32*a* of the holder member 32 at the rear end thereof, while a correction ribbon CR take-up spool 77 is rotatably mounted on the right end side wall of the holder member 32. This take-up spool 77 is provided with a ratchet wheel 78 having a plurality of teeth. Beneath the ratchet wheel 78, a ratchet pawl member 79 is rotatably supported by a pivot pin 86 on a pivot plate 85 which is vertically mounted on the holder bracket 33. A ratchet pawl 79*a* upwardly protrudes from the ratchet pawl member 79 in such a manner as to be engaged with the ratchet wheel 78 from the front thereof, wherein the ratchet pawl 79*a* causes the ratchet to rotate one tooth thereof at a time. This ratchet pawl member 79 is resiliently urged to be turned counterclockwise in FIG. 17 by the biasing force of a coiled spring 87 wound around the pin 86, and hence the ratchet pawl 79*a* is normally engaged with the teeth of the ratchet wheel 78.

As has already been explained with respect to the cam mechanism 50, assume that the phase angle of the lifter cam 21 at the print start position is 0 degrees. Referring to FIGS. 15 to 19, when the lifter cam 21 is rotated from a phase angle of 0 degrees (see FIG. 16) in the non-printing direction by about 55 degrees, that is, a phase angle of −55 degrees, the first follower pin 52 advances upward along the first tilt cam surface 21*b* at phase angles between about −5 degrees and about −43 degrees, and reaches the second tilt cam surface 21*c*. At this time, the first follower pin 52 is displaced upward by about 2 mm relative to the position of the reference cam 21*a*. In FIGS. 17 and 19, a solid line designates the lifter cam 21; a dashed line, the ribbon supply cam 22; and a two-dot chain line, the first swing member 69.

When the lifter cam 21 is rotated at a high speed in the printing direction from a phase angle of about −55 degrees to a phase angle of 90 degrees, the first follower pin 52 travels along the second tilt cam surface 21*c* until it reaches the outer cam surface 21*d* (see FIG. 19). At this moment, the holder member 32 is switched to the erasing position in which the correction ribbon CR is situated opposite to the print hammer 27. As was aforementioned, during this positional switching of the holder member, the second follower pin 58 is brought in meshing engagement with the pin guide cam 21*k* from the outside thereof, whereupon the first follower pin 52 is nominally spaced apart from the outer cam surface 21*d*, and the tip end of the first follower pin 52 inevitably abuts against the outer edge wall 21*e*.

When the first follower pin 52 is located at the position P1 during its travel, the ratchet pawl member 79 is brought into meshing engagement with the ratchet wheel 78, and then the ratchet wheel 78 is angularly rotated by one tooth thereof at the position P2 as the holder member 32 is uplifted. Thereby, the correction ribbon CR is taken up by a predetermined length over the take-up spool 77 for stepwise feeding. In this instance, the first follower pin 52 is positioned by about 5.7 mm above the reference cam 21*a*.

Incidentally, as mentioned above, in order to ensure a given impacting force for the print hammer 27 in the erasure operation, the first follower pin 52 is sharply moved upward by about 5.7 mm when the motor 16 is energized to rotate at a high speed in the printing direction P from a phase angle of about −55 degrees to a phase angle of 90 degrees. During the sharp rise of the holder member 32, in conjunction with the above displacement, the holder member 32 tends to be rotated around the support shaft 34 under its own inertia upward beyond the erasing position to a much greater extent.

Figure 18:
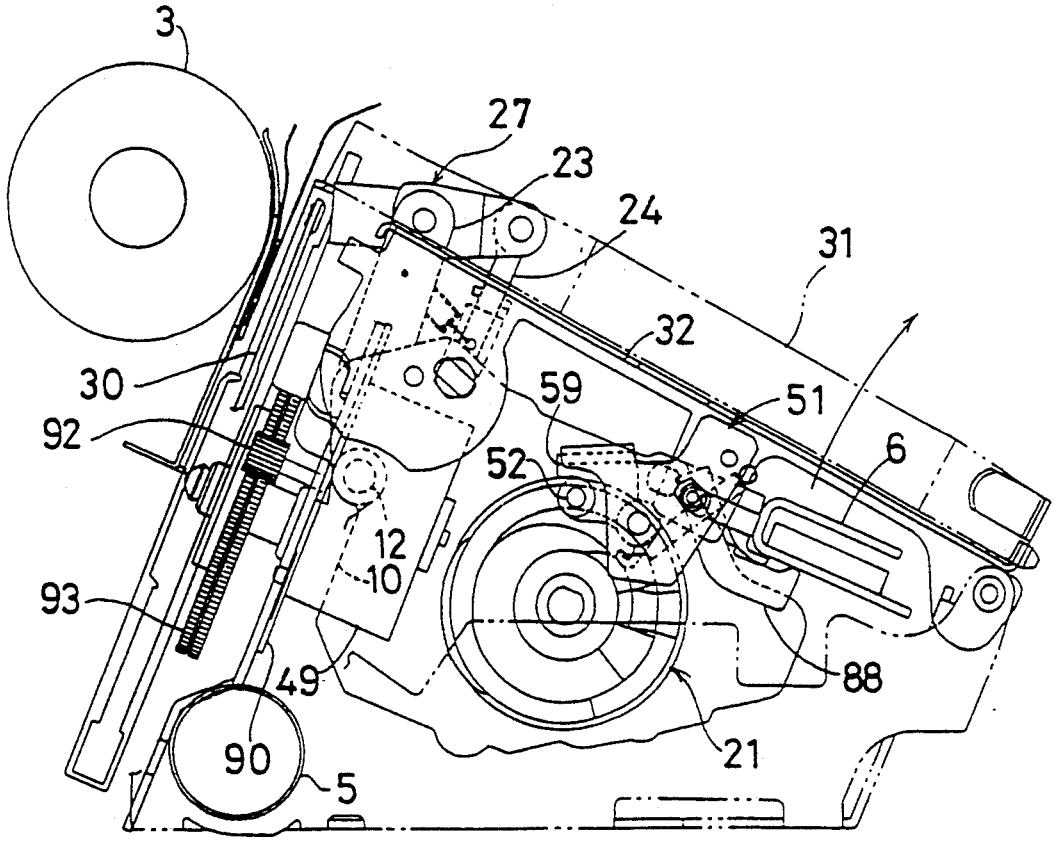
FIG. 18 is an illustration similar to FIG. 1 schematically showing the internal mechanism in the erasing state.
Figure 19:
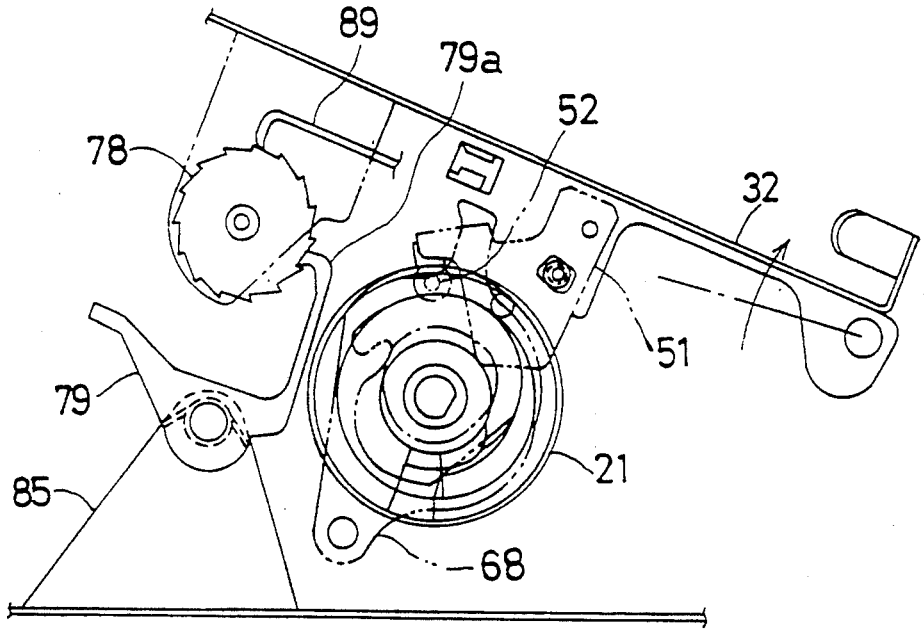
FIG. 19 is an illustration similar to FIG. 17 showing the holder member switched to the erasing position.

To prevent this, as shown in FIGS. 16 and 18, a swing limiter plate 88 (corresponding to a locking arm member) made of a curved plate is attached at the rear end thereof to the side wall 32*a* of the holder member 32 in such a manner that the front end thereof is situated below the guide member 6.

This swing limiter plate 88 is positioned below the guide member 6 while the holder member 32 is situated at the print position shown in FIG. 16. Meanwhile, when the holder member 32 is located at the erasing position shown in FIG. 18, the swing limiter plate 88 abuts against the lower portion of the holder member 32, thereby preventing the holder member 32 from being swung upward far beyond the erasing position. The swing limiter mechanism is constituted of the guide member 6 and the swing limiter plate 88.

After the erasure operation carried out by the angular rotation of the lifter cam 21 in the printing direction P from a phase angle of 90 degrees to a phase angle of about 270 degrees, the lifter cam 21 is reversely rotated in the non-printing direction up to a phase angle of −90 degrees. At this time, this lifter cam 21 is lowered to the printing position under its own weight, as shown in FIG. 17, in accordance with the displacement of the first follower pin 52 from the outer cam surface 21*d* to the reference cam 21*a* via the shallow depth region 21*h* and the tilt surface 21*i*. During the downward shift of the lifter cam to the printing position, the ratchet pawl 79*a* is brought in meshing contact with the next tooth of the ratchet wheel 78 by means of a reverse rotation preventing pawl 89 engaged with the ratchet wheel 78. Then, the motor 16 is rotated to a phase angle of 0 degrees.

Figure 15:
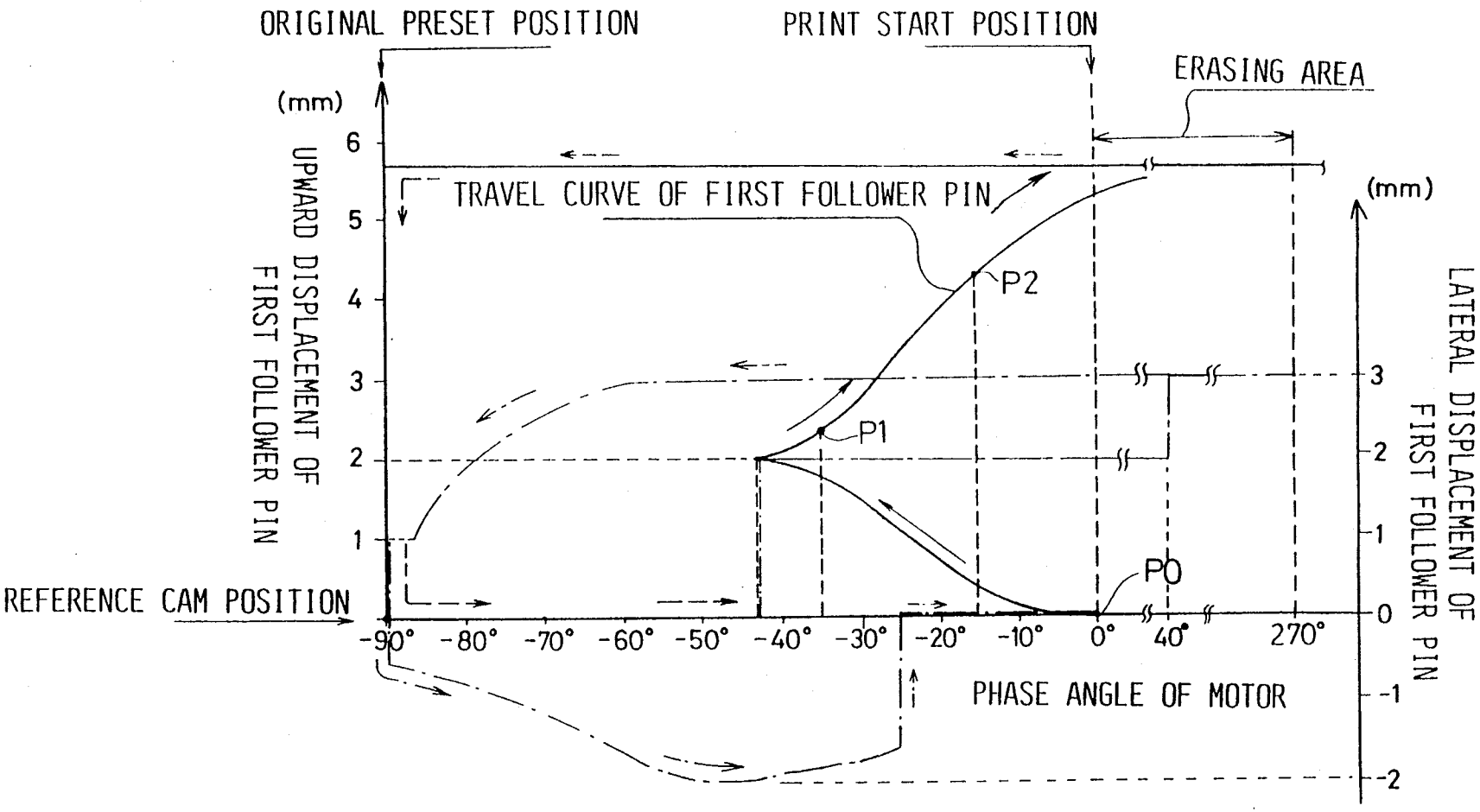
FIG. 15 is a graph showing the travel curve and longitudinal displacements of a first follower pin.

As illustrated by the dashed line in FIG. 15, when the holder member 32 is angularly moved downward from the erasing position to the print position, and when the lifter cam 21 is angularly moved to a phase angle of 0 degrees, the first follower pin 52 is displaced from +3 mm to −2 mm with respect to the position of the reference cam 21*a*. Namely, the first follower pin 52 travels leftward by about 5 mm, which corresponds to the total amount of displacement.

This total displacement amount of the first follower pin 52 can be subdivided into three phases: about one third of the total amount corresponds to displacement toward the shallow depth region resulting from the angular movement of the lifter cam 21 from a phase angle of about −60 degrees to a phase angle of −90 degrees; about one third of the total amount corresponds to displacement toward the left end surface 21*g* via the tilt surface 21*i* under the weight of the holder member 32 at the angular position of −90 degrees and the biasing force of the tension spring 97 (see FIG. 16) that resiliently urges the holder member 32; and about one third of the total amount corresponds to displacement resulting from the angular movement of the lifter cam 21 from a phase angle of −90 degrees to a phase angle of 0 degrees. Thus, the leftward displacement of the first follower pin 52 is effected stepwise, which in turn renders the motion thereof smooth. Eventually, the lowering of the holder member 32 to the print position after the erasure operation can be ensured.

A release mechanism 80 will be explained hereunder with reference to FIGS. 10, 13 and 14, wherein the release mechanism rotates the carriage 14 to the release position in order to change the daisy wheel 30. The release lever 82, rotatably supported by the main frame 8*a*, is engaged at the rear end thereof with the front end of a coupling member 84 from above, which is rotatably supported by the main frame 8*a* with a pin 83. This coupling member 84 is engaged at the rear end thereof with the front end of a swing member 81 from below, which is mounted on the support shaft 42. With this arrangement, when the release lever 82 is angularly shifted from the print position, designated by a solid line, to the release position, designated by a two-dot chain line in FIG. 14, the coupling member 84 is rotated clockwise, whereupon the swing member 81 is rotated counterclockwise.

Figure 20:
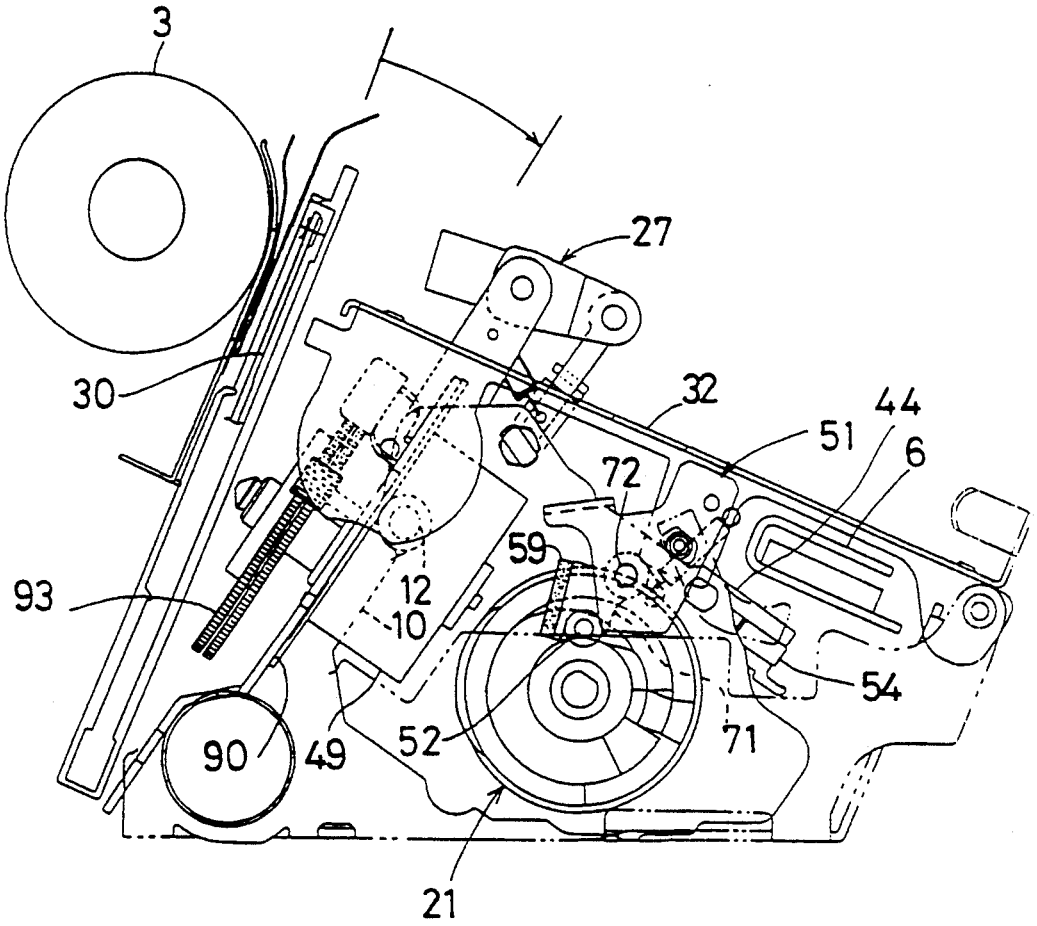
FIG. 20 is an illustration similar to FIG. 1 showing the carriage in the released state.

As a result of this, the abutment member 44, integrally coupled with the release lever via the swing lever 81 and the support shaft 42, is rotated counterclockwise, and is disengaged from the guide member 6, whereby the carriage body 14 is moved on the guide shaft 5 to a release position shown in FIG. 20.

As shown in FIGS. 8 and 20, since the rotating member 71 is rotatably positioned with respect to the support member 51, the first follower pin 52 travels downward in engagement with the reference cam 21*a* in accordance with the downward angular movement of the lifter cam 21. Consequently, the carriage body 14 is angularly moved to the release position in which the daisy wheel 30 can be removed, and hence a sufficient removal space is ensured, thereby allowing the removal of the daisy wheel 30.

After the replacement of the daisy wheel 30, the carriage 7 is rotated to return to the preset position by turning the release lever 82 toward the platen 3. However, as seen in FIG. 11, the improper turning of the release lever 82 may cause a stable state wherein a part of the abutment member 44*b* and a part of the bearing 54 are brought into contact with the guide member 6, namely, a so-called half-locked state wherein the guide 44*a* fails to be engaged with a lower end part of the guide member 6, and the bearing 54 is abnormally brought into contact with the rear end surface of the guide member 6.

Figure 12:
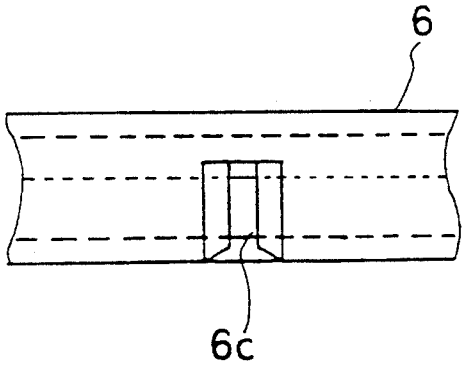
FIG. 12 is an illustration viewed from arrow G of FIG. 10.

As shown in FIGS. 10 to 12, a substantially V-shaped notch 6*c* is formed in one part of a rear and left end portion of the guide member 6, i.e., the non-print area of the guide member 6 where the carriage 7 performs no printing operation. The notch 6*c* extends from a location, which is somewhat higher than the middle in the height direction of the guide member, to a lower wall portion 6*b*.

With this notch, if the abutment member 44 enters the half-locked state after the replacement of the daisy wheel 30, the bearing 54 will pass through this notch 6*c* while the carriage 7 traverses leftward to the preset position, until it abuts against the left end side wall panel 2, for initial setting purposes. At this time, the bearing 54 is kept out of contact with the guide member 6, and the abutment member 44 is angularly and movably urged counterclockwise in FIG. 11 by means of the coiled spring 56 wound around the support shaft 42. Hence, the abutment member 44 is rotated to return to the normal abutting position designated by the two-dot chain line by the biasing force of the coiled spring 56, and the half-locked state is automatically canceled.

A position adjustment will now be described in reference to FIG. 13, wherein the center of a type face is aligned with the center of the print hammer 27. The wheel drive motor 49, made up of a stepping motor, is sustained by a motor holder 90. This motor holder 90 is mounted to a non-illustrated wheel holder member by a pair of machine screws 91 via a pair of arcuate support holes 90*a*. A drive gear 92, secured to the drive shaft of the wheel drive motor 49, is brought in meshing engagement with a wheel drive gear 93 which is rotatably supported by the wheel holder member, and this wheel drive gear 93 drives to rotate the daisy wheel 30.

Figure 13:
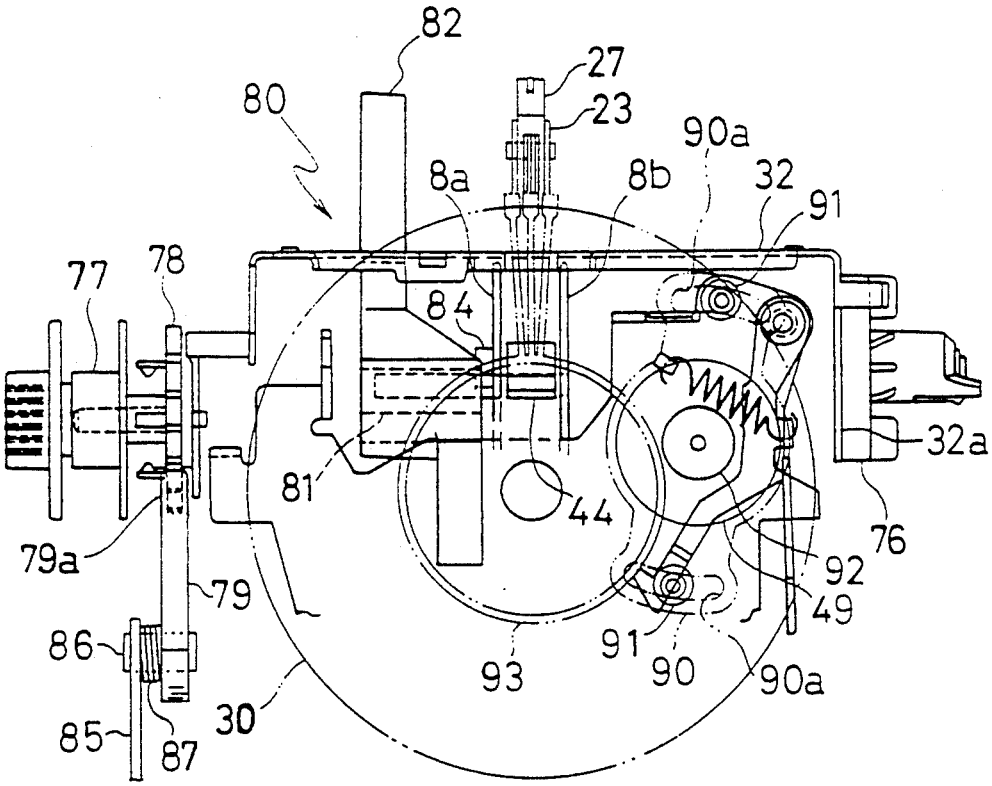
FIG. 13 is a rear view showing the principal parts of the internal mechanism.
Figure 14:
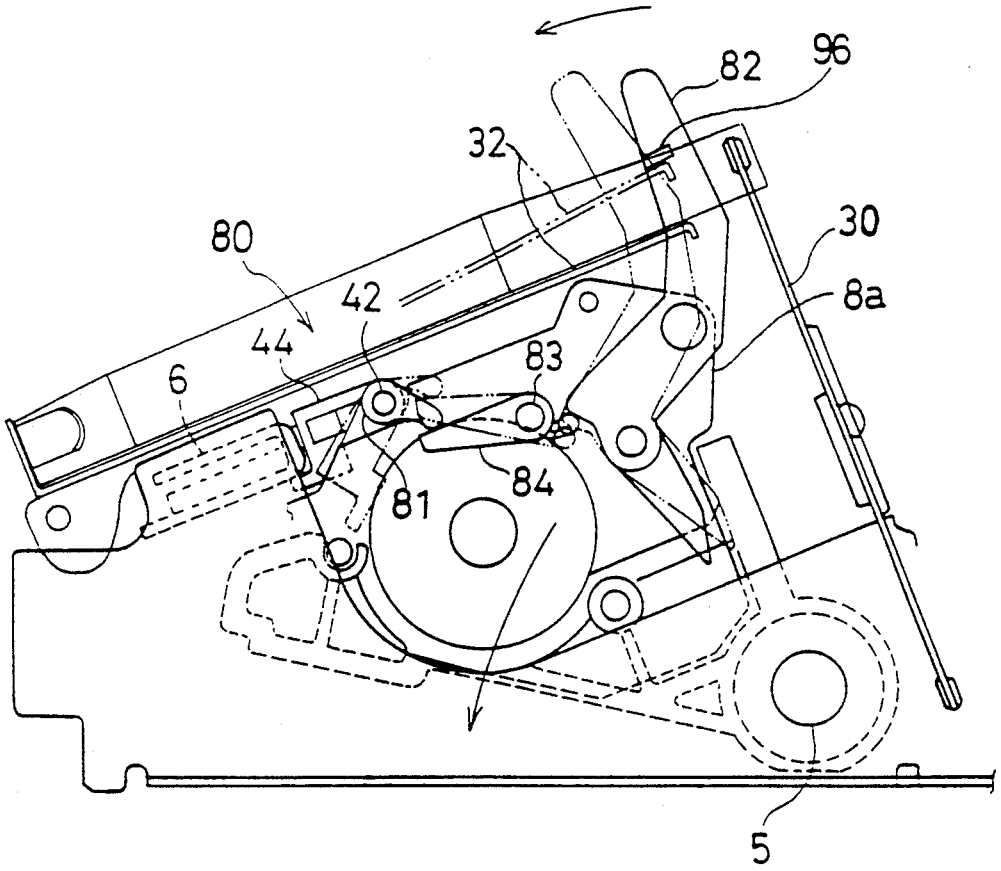
FIG. 14 is a side elevation view of the internal mechanism of assistance in explaining a release mechanism.

With the wheel drive motor 49 energized at a given excitation phase, the motor holder 90 is rotated clockwise or counterclockwise in FIG. 13 via the support holes 90*a* by loosening the machine screws 91, whereupon the wheel drive gear 93, that is, the daisy wheel 30, is rotated counterclockwise or clockwise via the drive gear 92, whereby the center of a type face can be easily brought in alignment with the center of the print hammer 27.

By the way, the typewriter 1 of this invention is carefully packaged with predetermined packaging materials, and is typically delivered from a manufacturing factory by railroad. During the transfer from the factory to users, this packaged typewriter 1 may be dropped. In this case, the packaged typewriter experiences shocks from various directions. It may be possible to presume that the typewriter 1, especially the carriage 7, will suffer from shocks transmitted in the lateral direction thereof from a plurality of shocks. In that event, however, the carriage 7 is protected from damage because it is laterally secured, in usual cases, by given fixed metal fittings to prevent the carriage from being laterally moved.

In the case where the carriage 7 is rotated counter-clockwise around the guide shaft 5 as shown in FIG. 2, the carriage 7 is received by the guide member 6 via the abutment member 44 and the support shaft 42, and hence the carriage 7 can withstand shocks.

Meanwhile, in the case where the carriage is rotated clockwise, the carriage 7 is held against the non-illustrated wheel drive mechanism and non-illustrated paper which are disposed right behind the carriage, whereby these may be deformed. However, as shown in FIGS. 2 and 7, a large washer 94 is secured to a front end part of the main frame 8*a* by a machine screw, and hence the clearance between the washer 94 and the guide member 64 is rendered nominal. Accordingly, the clockwise rotation of the carriage 7 due to shocks can be surely prevented by the washer 94 in contact with the guide member 6.

As mentioned above, the swing limiter plate 88 fixed to the side wall 32*a* of the holder member 32 abuts against the guide member 6 on the lower side thereof in the erasing operation so as to restrain the holder member 32 from being swung beyond the erasing position. Consequently, it is possible to certainly erase a character with the correction ribbon CR facing the type wheel 30.

Additionally, the tension spring 97 for resiliently urging the holder member 32 downward can be prevented from being extensionally deformed because the holder member 32, which is liable to be lifted up via the elastic members together with the ribbon cassette 31, can be restrained from being swung upward even in the case where the ribbon cassette 31 is lifted up for replacement.

The swing limiter plate 88 may be fixed in an arbitrary position of the holder member 32, where the shape of the swing limiter plate 88 may be changed according to the fixing position. In place of the swing limiter plate 88, a locking member 96 may be projected at the upper end of the release lever 82, as illustrated in FIG. 14. The locking member 96 abuts against the holder member 32 from above so as to restrain the holder member 32 from being swung above beyond the erasing position when the holder member 32 is swung to the erasing position. The locking member 96 may be projected in an arbitrary position of the carriage body 14.

As is apparent from the above description, in the printer according to one aspect of the present invention, the swing limiter mechanism is provided for restraining the holder member from being lifted up beyond the erasing position in the erasing operation, thus ensuring certain erasure of a character when the correction ribbon faces the type wheel.

Moreover, it is possible to restrain the upward swing position of the holder member when the print ribbon is lifted up for replacement. As a result, the tension spring can be prevented from being extensionally deformed even if the holder member is resiliently urged downward by the tension spring.

Certain modifications and changes to the invention will be apparent to those skilled in the art. The description herein is not intended to be limiting to the invention as defined in the appended claims.

What is claimed is:

1. A printer comprising:

a body;

a platen rotatably secured to said body;

a guide shaft secured to said body parallel to said platen;

a guide member secured to said body, parallel to said platen;

a carriage axially movably supported by said guide shaft and guided by said guide member, wherein said carriage supports a type wheel, a print hammer adjacent said type wheel, a print mechanism for driving said print hammer, a swing limiter mechanism, and a holder member for holding a print ribbon and a correction ribbon adjacent said print hammer, and wherein said carriage further includes a frame, an abutment member pivotally connected to said frame and engaging said guide member to guide lateral movement of said carriage, and a release mechanism connected to said frame for releasing a portion of said carriage from said guide member by disengaging said abutment member, said swing limiter mechanism being connected to said release mechanism and abutting said holder member when said abutment member is disengaged from said guide member and being spaced from said holder member when said abutment member is engaged with said guide member, said holder member being movable between a print position in which the print ribbon faces said print hammer and an erasing position in which the correction ribbon faces said print hammer and being restrained against movement beyond said erasing position by said swing limiter mechanism.

2. The printer of claim 1, wherein said holder member is pivotally coupled with respect to said guide shaft, and said swing limiter mechanism is a locking arm which interferes with the pivotal movement of said holder member.

3. The printer of claim 1, wherein said swing limiter mechanism is a locking arm that engages said holder member in said erasing position.

4. The printer of claim 1, wherein said release mechanism includes a release lever and said swing limiter mechanism is a locking arm extending from said release lever, said locking arm interfering with upward pivotal movement of said holder member.

5. The printer of claim 1, further comprising correction ribbon taking-up mechanisms disposed in said holder member and said carriage body for feeding the correction ribbon stepwise while said holder member is moved between said print position and said erasing position.

6. The printer of claim 1, wherein said print mechanism includes a cam assembly and a follower pin assembly engaging said cam assembly to activate said print hammer and to move said holder member, wherein said follower pin assembly is coupled to said holder member and movement of said cam assembly causes said holder member to pivot upwardly.

7. The printer of claim 1, wherein said holder member is supported for free pivotal movement on a holder bracket coupled to said guide shaft.

8. A printer comprising:

a platen;

a guide shaft disposed in parallel to said platen;

a guide member disposed in parallel with said platen;

a carriage reciprocated along said guide shaft and guided by said guide member, said carriage including a body carrying a type wheel and a print hammer, and a holder means for mounting a print ribbon and a correction ribbon and movable between an erasing position in which the correction ribbon is able to face said platen, and a print position in which the print ribbon is able to face said platen;

a swing limiter means for restraining said holder means from being elevated beyond said erasing position; and an abutment member pivotally connected to said carriage body and engaging said guide member to guide lateral movement of said carriage, and a release means connected to said carriage body for releasing a portion of said carriage from said guide member by disengaging said abutment member, said swing limiter means being connected to said release means and abutting said holder means when said abutment member is disengaged from said guide member and spaced from said holder means when said abutment member is engaged with said guide member.

9. The printer of claim 8 wherein said holder means is pivotally mounted with respect to said guide shaft and said swing limiter means is a locking arm which interferes with the upward pivotal movement of said holder means.

10. The printer of claim 8, wherein said swing limiter means is a locking arm that engages said holder means in said erasing position.

11. The printer of claim 8, wherein said release means includes a release lever and said swing limiter means is a locking arm extending from said release lever, said locking arm interfering with upward pivotal movement of said holder means.

12. The printer of claim 8, wherein said holder means is supported for free pivotal movement on a holder bracket coupled to said guide shaft.

13. The printer of claim 8, further comprising a correction ribbon taking-up means disposed in said holder member and said carriage body for feeding the correction ribbon stepwise while said holder means is moved between said print position and said erasing position.

* * * * *